US007753127B2

(12) United States Patent
Tseytlin

(10) Patent No.: US 7,753,127 B2
(45) Date of Patent: Jul. 13, 2010

(54) BOTTOMHOLE TOOL AND A METHOD FOR ENHANCED OIL PRODUCTION AND STABILIZATION OF WELLS WITH HIGH GAS-TO-OIL RATIO

(75) Inventor: Simon Tseytlin, Middle Village, NY (US)

(73) Assignee: Tseytlin Software Consulting, Inc., Middle Village, NY (US)

( * ) Notice: Subject to any disclaimer, the term of this patent is extended or adjusted under 35 U.S.C. 154(b) by 183 days.

(21) Appl. No.: 12/103,793

(22) Filed: Apr. 16, 2008

(65) Prior Publication Data

US 2009/0260806 A1 Oct. 22, 2009

(51) Int. Cl.
*E21B 43/00* (2006.01)
*E21B 43/12* (2006.01)
*E21B 34/08* (2006.01)

(52) U.S. Cl. ..... 166/370; 166/250.15; 166/250.07

(58) Field of Classification Search ..... 166/250.15, 166/250.07, 53, 372, 370
See application file for complete search history.

(56) References Cited

U.S. PATENT DOCUMENTS 4,442,710 A 4/1984 Meng
5,105,889 A 4/1992 Misikov
5,752,570 A 5/1998 Shaposhnikov
5,871,047 A 2/1999 Spath
5,927,402 A * 7/1999 Benson et al. ..... 166/65.1
5,937,945 A * 8/1999 Bussear et al. ..... 166/250.15
5,967,234 A 10/1999 Shaposhnikov
7,172,020 B2 2/2007 Tseytlin

* cited by examiner

*Primary Examiner*—Kenneth Thompson
*Assistant Examiner*—Cathleen R Hutchins
(74) *Attorney, Agent, or Firm*—Boris Leschinsky

(57) ABSTRACT

A bottomhole tool and a method for optimizing oil production rate from an oil well with high gas-to-oil ratio and stabilizing thereof in case of occurrence of a gas cone or gas skin conditions are disclosed. The resistance of the adjustable multi-stage flow resistor is determined by a position of a telescoping needle, which in turn is defined by a driving means including a motor and a gearbox. The motor is driven via a cable from a surface by a control means adapted to receive information about the bottomhole parameters from local sensors via a sensor cable. Methodology explaining the principles of maintaining well stability is also disclosed. Automatic adjustment of the bottomhole pressure is maintained over a wide range of operating parameters throughout the life of the well to maximize its oil output.

4 Claims, 5 Drawing Sheets

BOTTOMHOLE TOOL AND A METHOD FOR ENHANCED OIL PRODUCTION AND STABILIZATION OF WELLS WITH HIGH GAS-TO-OIL RATIO

BACKGROUND OF THE INVENTION

The present invention relates generally to a method and improved devices for increasing the production of oil. More specifically, the bottomhole tool and the method of the invention provide for maintaining the bottomhole pressure at a level considered optimum for maximizing oil production in a well with high gas-to-oil ratio (GOR). The most advantageous implementation of the present invention is in wells with high GOR defined as GOR greater than 600 cubic feet per barrel. In these wells the tool and the method of the invention can be used when the bottomhole pressure is lower than the bubble point pressure as well as in all cases when the gas cone has appeared such as in flowing, gas lift, and pump regimes of oil production. Another useful implementation of the invention is in GOR wells when a so-called gas cone or gas skin effects take place. These detrimental effects generally lead to destabilization of the well production process, fast increase of GOR and difficulties in managing the well.

This invention contains further improvements of my earlier U.S. Pat. No. 7,172,020 entitled "Oil Production Optimization and Enhanced Recovery Method and Apparatus for Oil Fields with High Gas-To-Oil Ratio", incorporated herein in its entirety by reference.

Optimization of oil production has been a goal of many methods and devices of the prior art. Generally speaking, the bottomhole behavior of oil mixed with gas and some other ingredients such as water, etc. has been described in a series of mathematical equations by Muskat. One specific publication of Muskat is incorporated herein by reference in its entirety and describes the mathematical model of oil reservoir: Muskat M. "The Production Histories of Oil Producing Gas-Drive Reservoirs", published in the Journal of Applied Physics in March of 1945, p.147-159.

For illustration purposes, a one-dimensional axis-symmetrical system of Muskat equations with corresponding PVT characteristics of fluid and dependencies of relative permeability $K_{ro}$, $K_{rg}$ from liquid saturation ($S_o$) can be described as follows:

$$\frac{1}{r}\frac{\partial}{\partial r}\left(r\frac{k_{ro}}{\mu_o B_o}\frac{\partial p}{\partial r}\right) = -158.064\frac{\phi}{k}\frac{\partial}{\partial t}\left(\frac{S_o}{B_o}\right)$$

$$\frac{1}{r}\frac{\partial}{\partial r}\left[r\left(\frac{k_{rg}}{\mu_g B_g} + \frac{Rs}{5.615}\frac{k_{ro}}{\mu_o B_o}\right)\frac{\partial p}{\partial r}\right] = -158.064\frac{\phi}{k}\frac{\partial}{\partial t}\left(\frac{S_g}{B_g} + \frac{S_o}{B_o}\frac{Rs}{5.615}\right)$$

where: P—pressure in formation; $S_o$—oil saturation in formation; $S_g$—gas saturation in formation; $R_s$—solution of gas in oil; $B_o$—oil formation volume factor; $B_g$—gas formation volume factor; $\mu_o$—oil viscosity; $\mu_g$—gas viscosity; $\phi$—formation porosity; K—formation permeability.

For practical purposes, Vogel had simplified the Muskat equations and adapted them to the calculations of oil producing formations. These equations are known as Vogel model and have subsequently been modified by others. One example of such publication is as follows: Vogel, *Inflow Performance Relationships for Solution-Gas Drive Wells*, as published in Journal of Petroleum Technology, January 1968, pp. 83-92, incorporated herein in its entirety by reference. Unfortunately, Vogel model does not work well in wells with high gas-to-oil ratio. According to Vogel, the dependency of oil rate production of bottomhole pressure is a constantly diminishing parabolic curve with a production peak at zero value of the bottomhole pressure, see for example FIG. 2 of the above mentioned article. In other words, the lower the bottomhole pressure, the higher the oil rate production from the formation. This is a gross simplification of the bottomhole processes in the formation. In fact, if the bottomhole pressure falls below saturation pressure in case of high GOR, relative permeability coefficient by oil decreases because of gas saturation increase, which in turn is a result of gas being released from oil. Viscosity of so degassed oil also increases. This leads to a decrease of productivity index of formation. This phenomenon affects the oil production rate more than the increasing depression. As a result, decreasing of the bottomhole pressure below saturation pressure can lead to a decrease in oil production rate, rather than to its increase as predicted by Vogel's model, see FIG. 1. In some extreme cases, reliance on Vogel's model will cause a complete switch in production from oil to gas. There is a need therefore for a method allowing calculating the oil production rate in high GOR wells with better accuracy then that allowed by Vogel's model.

It is also known that producing oil wells with high GOR (Gas-to-Oil Ratio) often lose their stability, and this process is accompanied by a sharp increase in GOR. Any attempts to stop this process by using a surface choke or other surface manipulations usually fail, and the well gradually switches into a gas mode. The physics of this process can be explained as follows: in case when a gas cone covers some holes of a perforated section of the well, quite often that well loses stability. This, in turn, leads to a continuing slow increase of the cone height followed by an increase in the gas stream and a decrease in the oil flow. This process continues until the well is completely switched to a gas mode. Even if a switch to a gas mode does not happen, the instability of the well does not allow efficient control of the bottomhole pressure by using a choke at the surface. Similar detrimental phenomena can occur because of formation of a gas skin effect near the bottom of the well. The physics of the skin effect is described in detail in my '020 patent. It also shows that this phenomena leads to a non-conventional shape of the IPR curve (Inflow Pressure Relationship, i.e. the dependence of well oil flow rate of the bottomhole pressure). A notable feature of this curve is the presence of a certain threshold value of the bottomhole pressure (called "$P_{opt}$—optimal pressure"), at which the greatest possible oil flow rate from a reservoir can be achieved (FIG. 1).

The need exists therefore for a device and method of restoring and maintaining the stability of production in high GOR wells even in the presence of gas cone and gas skin effects.

SUMMARY OF THE INVENTION

Accordingly, it is an object of the present invention to overcome these and other drawbacks of the prior art by providing a novel bottomhole tool and method for optimizing and maximizing the production of oil from an oil well, particularly an oil well with high GOR and maintaining the stability of such production.

It is a further object of the present invention to provide a bottomhole tool allowing adjustment of bottomhole pressure from the surface in a wide range of formation conditions and throughout the life of the well without the need to replace the device.

It is yet a further object of the present invention to provide a bottomhole tool allowing adjustments of bottomhole pressure in a desired range such that the reliability of that tool is increased by providing larger values of clearances between the moving and non-moving parts of the tool. Increased reliability would depend on the resistance of the tool to jamming by sand and other particles present in oil flow.

The device of the invention is an improvement to my bottomhole tool first described in the '020 patent. That tool was described as having a custom multi-stage flow resistor designed for each individual well. Once designed and implemented, the bottomhole tool of the '020 patent has a limitation of depending on the specific parameters of the tool that were selected during its initial construction, namely the dimensions of the multi-stage flow resistor and the stiffness of the return spring activating the movements of the resistor. As the conditions in an actual well change over time, the ability to maintain stable production is limited with that device. A redesigned bottomhole tool may be deployed in that case but that procedure is costly and time consuming.

The new bottomhole tool of the present invention addresses this point by providing an adjustable and remotely-controlled driving means of activating the movement of the multi-stage flow resistor. These driving means include in the most preferred configuration an electrical motor with an appropriate gear box designed and sized to be placed in place of a return spring and cause vertical movement of the multi-stage resistor in response to a command from the surface or automatically in response to an on-board sensing and computing means. This approach greatly expands the applicability of the bottomhole tool of the invention and obviates the need to replace the entire tool from time to time as the well conditions change.

Using the adjustable bottomhole tool of the invention is a critical part of a newly proposed method of creating new points on the IPR curve where the oil production is stable. This is achieved by adjusting the resistance at the bottom of the well to change the shape and location of the lift curve of the well such that it intersects the IPR in a different and more advantageous way than prior to using the tool of the invention.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS OF THE INVENTION

Figure 1:
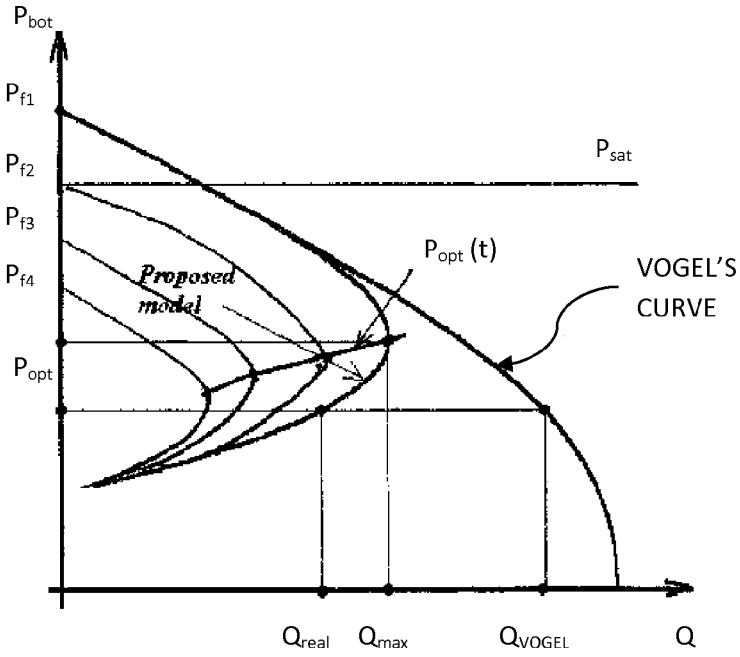
FIG. 1 is an inflow performance relationship curve according to Vogel and according to the '020 patent and present invention.
Figure 2:
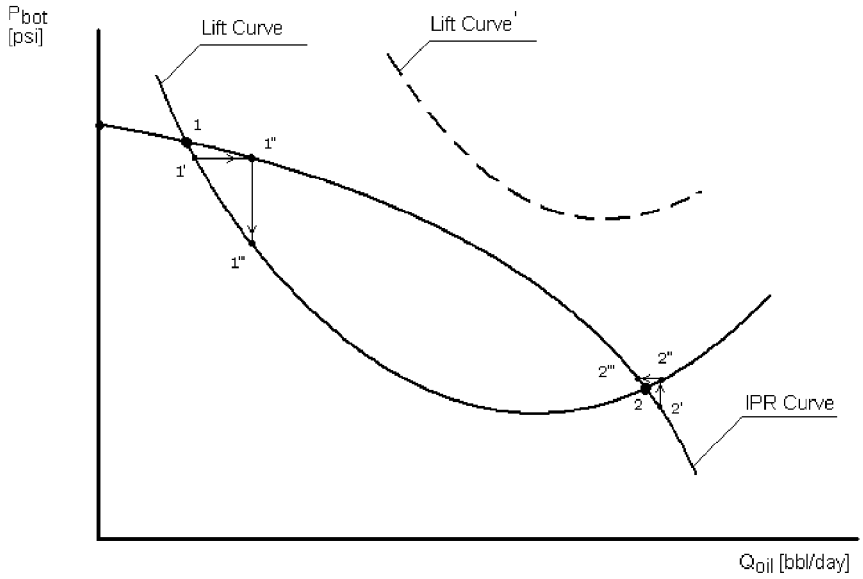
FIG. 2 is a graph illustrating how the various lift curves intersect with an IPR curve creating an unstable condition for the well.
Figure 3:
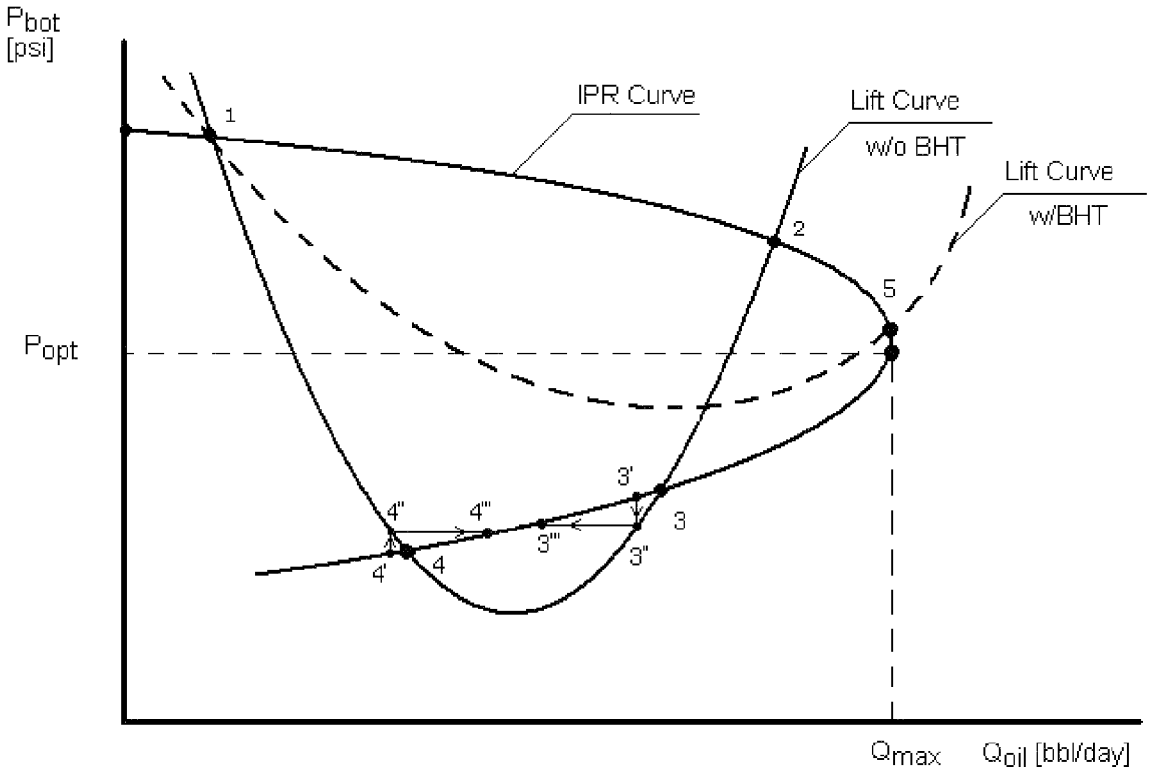
FIG. 3 is a graph showing how the use of the bottomhole tool of the invention changes the lift curve and explains why it restores stability of well production.

Continuing on FIGS. 1 through 3 now, the initial instability of well production may cause a further decrease of the bottom hole pressure, which leads not to an increase of the oil flow rate, as predicted by the Vogel's curve (traditionally used IPR curve to describe behavior of oil wells with high GOR), but, on the contrary, to its decrease.

At the same time, a slow increase of GOR occurs. This phenomenon can be explained by the inflow equation:

$$Q_{oil} \sim K(P,S_L)\cdot(P_{form}-P_{bottom}),$$

where $Q_{oil}$—oil rate $K(P,S_L)=(ko*h)/(\mu*Bo)$—production index $P_{form}$—formation pressure $P_{bottom}$—bottomhole pressure ko—relative oil permeability h—length perforation interval μ—oil viscosity Bo—oil formation volume coefficient $S_L$—saturation of liquid.

As the bottomhole pressure decreases, the oil flow rate increases with increased reservoir drawdown (depression) ($P_{form}-P_{bottom}$). However, after the pressure achieves an optimum value, the oil flow rate starts to decrease, because the effect of increased drawdown (depression) becomes less significant than a detrimental influence of the reduced relative permeability (in case of a gas skin effect) or an interval h (in case of a gas cone). Simultaneously, the relative permeability for gas increases, as it leads to an increase in a gas stream and, respectively, in GOR.

It is known, that to identify a "working point" (values of the bottomhole pressure and oil flow rate that brings the reservoir production and oil lift to a balance) it is necessary to find points of crossing of an inflow curve (IPR) and a lift curve (LC). In case of a well with high GOR, there usually exist two crossing points—one of which is "stable" while the other is "unstable" (FIG. 2). For wells with high GOR, the lift curve always has descending and ascending parts (see The Technology Artificial Lift Methods. K. E. Brown, vol. 4). In terms of physics, it may be explained by the fact that gas "slips" through the oil in case of the annular flow in the pipe.

In a traditional case, when a reservoir is approximated by the Vogel's curve, the system "well—reservoir" is unstable if the slope of the lift curve is negative at a crossing point ("point 1") while it is stable if that slope is positive ("point 2")—see FIG. 2.

If IPR and LC curves do not cross each other, the lift production is not possible for a given production arrangement (Lift Curve' on FIG. 2). In this case, some adjustments in the pipes diameter or the choke might be needed. If these adjustments do not lead to a crossing of the curves either, a gas lift or pump production mode may be a solution.

The following discussion illustrates how "point 1" corresponds to an unstable mode of the system "well—reservoir". The assumption is made here that the flow rate at point 1 has slightly increased because of some fluctuations in the reservoir (FIG. 2. p. 1'). The increase of oil flow rate will cause in that case a decrease in the bottom hole pressure (reaction of the well, see p.1" on the lift curve). This, in turn, will cause a further oil flow rate increase (FIG. 2, p. 1'''), and so on. The operational mode of the system will be changing until it reaches point 2 that corresponds to a stable mode. In reality, the increase of the flow rate (p.2' in FIG. 2) will lead to an increase of the bottomhole pressure according to the lift curve (p.2" in FIG. 2). That, in turn, will lead to a decrease of the oil flow rate from the reservoir as it reverses back to the initial point 2. Therefore due to the reaction of the well, a negative feedback takes place, and it makes the mode of the system to be stable at point 2. At point1, on the contrary, reaction of the well causes a positive feedback.

In case of the inflow curve being similar to that described in my '020 patent, namely when it has a maximum value at a certain non-zero value of the bottomhole pressure, two or four crossing points may exist (see FIG. 3). In that case, there will appear another stable point (point 4) and another unstable point (point 3) on the lift curve. A negative slope of the lift curve will now correspond to a stable point, and a positive slope will correspond to an unstable point.

Stability of system can be analyzed as follows. A decrease in the flow rate at point 3 will lead to a decrease of the bottomhole pressure (see point 3' on the IPR curve and point 3" on the lift curve); that, in turn, will lead to further decrease in the flow rate as positive feedback is developed. It further leads to moving the system to point 4 on the curve, which corresponds to a stable mode. Indeed, if the flow rate decreases further (FIG. 3 p.4'), the reaction of the well will lead to an increase in the bottomhole pressure (point 4"), which, in turn, will lead to an increase in oil flow rate. The system will return to point 4 and therefore point 4 corresponds to a stable mode of system operation.

This phenomenon explains why sometimes a well switches to a gas mode when a gas cone or a strong gas skin effect takes place, and hence the bottomhole pressure becomes less optimum. This effect causes a sharp increase in GOR.

Therefore, only the presence of a decreasing portion in an inflow curve and the "type 3 and 4" points on this curve can explain the effect of switching oil producing wells into a gas mode. The traditional Vogel's curve does not provide any explanation of this phenomenon.

Using a bottomhole tool (BHT) of the invention allows changing of the shape of the lift curve, so that the oil producing well is not allowed to switch into a gas mode. Moreover, the bottomhole tool allows reaching and maintaining a stable mode of the system "well—reservoir" while being close to the maximum possible oil flow rate. FIG. 3 illustrates how point 5 and dashed line correspond to the lift curve when the bottomhole tool is used. It is possible to chose specific design parameters of a bottomhole tool (such as the lengths and diameters of the telescopic needle for example) in a way so that its characteristics (dP=F (Qoil)) and the ability to control the position of the needle from the surface will together allow excluding of "type 4" points from working points at the crossing of IPR and lift curves. Point 5 becomes now a working point, which corresponds to a stable operating mode of the well with the oil flow rate being close to the highest possible value.

For the crossing point of the lift curve and inflow (IPR) curve to be located near the maximum oil flow rate and to be maintained there for a long time despite changing of reservoir parameters, it is necessary to use the adjustable bottomhole tool with moving parts, as shown in my '020 patent.

Bottomhole tool also stabilizes the system, as it excludes a delay line from the control system. The delay line forms because of the presence of a long communication channel between a surface choke and the bottom of a well via a borehole filled with a gas-saturated fluid. It is known that the speed of sound in the gaseous mixture of oil and water and therefore the ability to transmit signals back and forth from the surface to the bottom of the well is limited to only dozens of meters per second causing significant delays in such transmissions. Presence of such a delay in the system "well—reservoir" could lead to occurrence of a positive feedback.

It is further suggested that the bottomhole tool of the invention allows to control the bottomhole pressure efficiently and hold it at an optimal level as compared with using a traditional surface choke frequently located thousands of feet away from the bottom of the well. This is particularly true since the control signal has to propagate through a compressible column of gas-saturated fluid in the well.

The task of controlling a producing reservoir often contradicts the task of optimizing the lift. Attempts to maintain the bottomhole pressure at an optimum level using a surface choke frequently worsen the lift of the oil. Use of the bottomhole tool of the invention for this purpose allows separating both problems and therefore more efficiently resolve them one at a time.

There are certain special cases that are also characterized by the IPR curve having a maximum value, but this maximum is not caused by a gas skin or a gas cone effect. For example, reduced formation permeability may be caused by deformation of pores in a reservoir when the bottomhole pressure drops below the hydrostatic pressure. This is especially typical for carbonate reservoirs: the greater the difference between the bottomhole pressure in a well and the formation pore pressure, the smaller pore and fractures sizes are. While the bottomhole pressure increases, the effective permeability may increase.

Figure 4A:
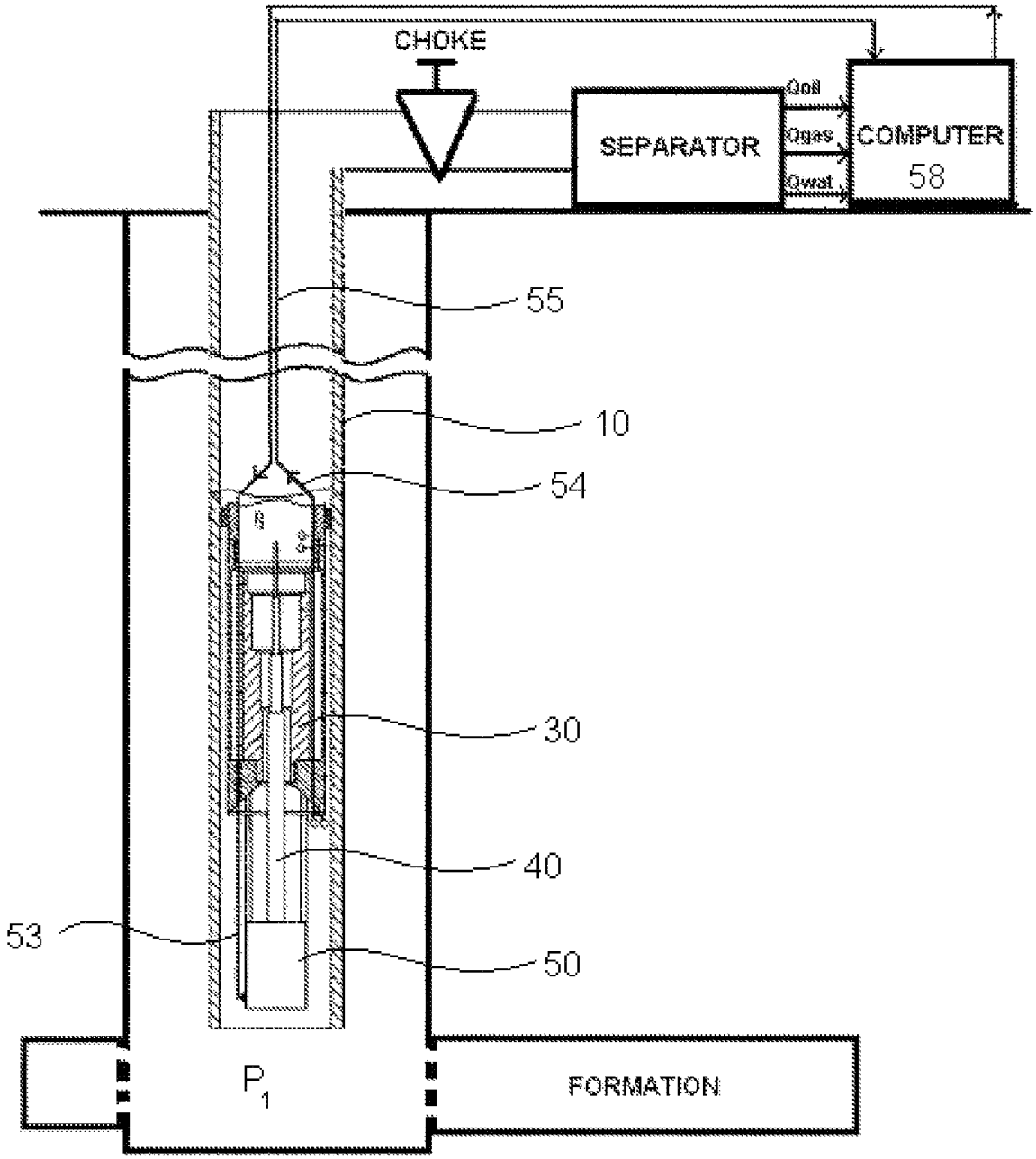
FIG. 4*a* is a general cross-sectional view of the bottomhole tool of the present invention along with all other elements of a typical well.
Figure 4B:
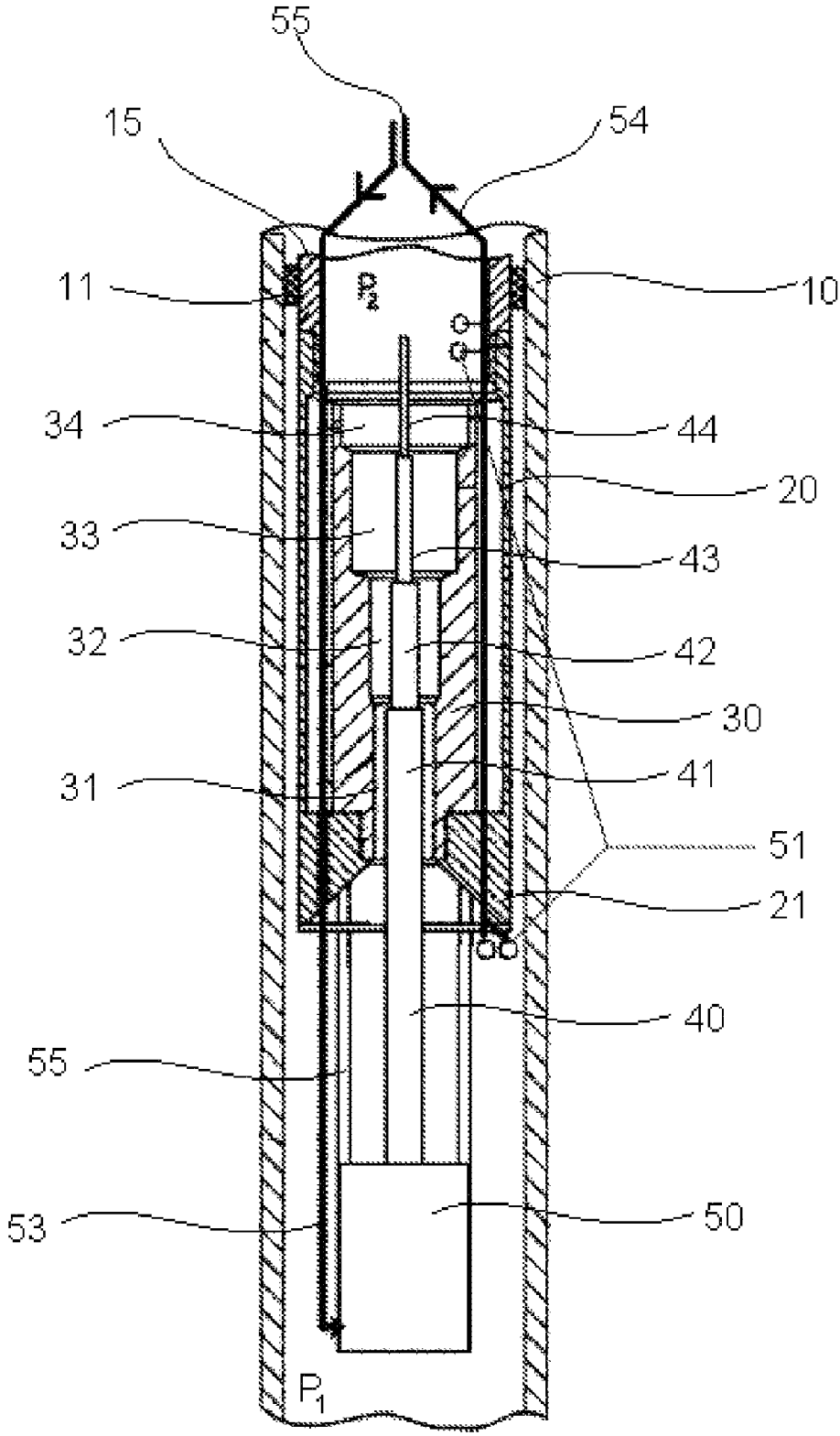
FIG. 4*b* is a close-up cross-sectional view of the bottomhole tool of the invention.

The design of the novel bottomhole tool is now described in greater detail and with reference to FIG. 4*a* and 4*b*. In many aspects, it is similar to my initial design described in the '020 patent and includes a set of round tubes with a telescopic needle moving along these axis. The bottomhole tool of the invention is mounted in a well 10 at the end of the pipe 15 sealed to the well 10 through the sealing ring 11. The housing 20 of the tool is attached to the lower end of the pipe 15 by any known means such as for example by a threaded connection as shown on the drawing. A multi-stage telescopic fluid resistor 30 is attached to the lower portion 21 of the housing 20 and contains cylindrical stages 31, 32, 33, and 34 having diameters decreasing toward the bottom of the device. Although the drawing shows four such stages, it should be understood that any appropriate number of stages starting with just two stages is contemplated by the present invention. Also contemplated by the invention are designs in which the diameter of successive stages does not continuously increase or decrease. In these designs, a combination of larger to smaller and back to larger stages is envisioned. All these provisions are designed to allow manipulating the shape of the lift curve using the geometry of the fluid resistor and the position of the telescopic needle so that new stable points of operation are created at the intersection of the lift curve and the IPR curve as described above. Provisions are further made to direct substantially all fluid flow into the central inside portion of the telescopic fluid resistor 30 through a tapered opening at the bottom of the lower portion 21 of the tool housing 20.

A multi-stage needle 40 is located inside the telescopic fluid resistor 30 and consists of several stages 41, 42, 43, and 44 having diameters increasing in the direction toward the bottom of the tool. These diameters are chosen in such a way that they are all smaller then the diameter of the smallest stage 31 of the resistor 30 so that the needle can travel up and down the entire length of the resistor 30 from a predefined top position to a predefined bottom position and stop at any position therebetween. Preferably, the difference between the largest stage 41 of the needle 40 and the smallest diameter 31 of the resistor 30 is sufficient enough for passing sand and other inclusions so as to prevent well clogging during operation. Exact diameters and lengths of the various stages of the needle 40 and the resistor 30 are calculated from the mathematical model as described in the '020 patent. It is also preferred to have the lengths of various stages of the needle 40 correspond to that of the resistor 30. In that case, the flow calculations are well defined to the series of several successive annular passages of well-defined lengths, at least at the lower position of the needle 40.

As opposed to the design described in the '020 patent, this invention describes the needle 40 as supported by and moved up and down by driving means 50 consisting of an electric motor with an appropriate gear reduction adapted to move the needle 40 up and down in response to a control signal. The driving means 50 are supported on the lower portion 21 by a series of struts 55 allowing oil and gas to enter into the opening in the lower portion 21.

The power and control signal to the driving means 50 are supplied through a drive cable 53 connecting the driving means 50 with a control unit such as for example a surface-based computer 58 forming the basis of such control unit. Also connected to the computer 58 via a sensing cable 54 are various sensors 51, such as pressure sensors located in selected appropriate areas of the bottomhole tool. They are adapted to convey necessary information such as pressures P1 below and P2 above the bottomhole tool back to the computer 58. Other information that can be advantageously collected by sensors 51 includes flow rates of various components of the well such as oil, gas, and water, their temperature, etc. both cables 53 and 54 can be combined into a single cable 55 once above the bottomhole tool. The motion of the needle 40 is therefore controlled by the action of the driving means so that the resistance of the multi-stage resistor 30 and can be adjusted at will from the surface via a computer 58.

In the beginning of the operation of the bottomhole tool of the invention, the needle 40 is usually completely located inside the resistor 30. In some cases however, it can be partially introduced, and in other cases it can be completely withdrawn from the lower portion of the resistor 30, depending on the well and formation conditions. After installation of the device and starting of the well, the phase oil permeability, in the near bottomhole zone of the reservoir increases and as a result of that, the oil flow rate increases. In response, the pressure differential across the device grows and sensed by sensors 51. Computer 58 is supplied with this information and based on a predetermined response, selects the new appropriate position of the needle 40, which is achieved by activating the driving means 50 and moving the needle 40 to that position.

When the needle 40 is completely pulled out of the resistor 30, the hydraulic resistance of the tool is minimal. Such resistance corresponds to a resistance of a system of telescopic pipes having a round cross-section. The pressure differential within the device in response to a further increase of flow rates will be based on a constant (minimal) hydraulic resistance of the lower stage 31 in addition to the next stage 32 and finally to further stages 33 and 34. If the flow rates decrease due to some changes in the reservoir and fluid parameters and reduction of the reservoir pressure, the needle 40 will be moved back up into the body of the resistor 30. This in turn adjusts the hydraulic resistance of the tool to a desired optimum level in order to maintain optimum bottomhole pressure and maximum oil flow rates according to the current conditions of the formation, reservoir pressure, and fluid parameters.

Previously proposed methodology for optimization and stabilization of a well as described in the '020 patent has a number of disadvantages that are resolved in the current invention, as follows:

The bottomhole tool built just on the basis of mathematical modeling and calculations doesn't always allow achieving sufficient accuracy needed for efficient control and optimization of the oil production, because physical processes that take place in the system "well—reservoir" and the bottomhole tool are quite complex. This is why this invention proposes controlling the needle motion based on the actual measured values of bottomhole parameters (e.g., pressure, oil/gas/water flow rate, temperature, etc.) periodically or constantly transmitted to the surface via a cable or by other means. The needle's position determines the pressure drop across the bottomhole tool, and that, in turns, allows maintaining the bottom hole pressure at (or very close to) the optimal level.

The presence of a spring in the bottomhole tool of the '020 patent, parameters of which are also to be specifically calculated for each particular well, is the second disadvantage of the earlier proposed technique. In this new invention, instead of a spring, a cable-controlled electric motor is used, which is supplied with the electric power and control signals from the surface through the same cable means 55 that is used to transmit bottomhole measurements to the surface. Control signals are generated on the basis of actual measurements combined with the modeling & simulation results by a surface control unit including a computer 58.

Another disadvantage of the earlier technique is that complex computer calculations are performed only during a bottomhole tool design stage. The new approach of the present invention allows fine tuning calculations in real-time based on constantly updated bottomhole information and by utilizing significant calculation power of a surface computer 58. This permits periodic adjustments to the bottomhole tool's characteristic immediately during the production process, so the efficiency and accuracy of the bottomhole control increases noticeably.

The new design of bottomhole tool expands its functional capabilities: without any modifications this tool can be used for conducting hydrodynamic tests of the formation (formation testing). It allows for periodical measurements of varying reservoir parameters and the current IPR curve to better determine the most optimal position of the bottomhole tool needle. This information will significantly enhance the accuracy and efficiency of the proposed method for stabilizing a well and its production optimization.

Sequence of Operations in Utilizing the Present Invention:

1. Calculate critical parameters of the reservoir by utilizing comprehensive mathematical models as described before. These critical parameters include formation pressure, flow rate for oil, gas, and water, oil recovery factor, and a family of IPR curves.
2. Based on the calculated family of IPR curves, a particular value of the bottomhole pressure Popt (t) required for the most optimal oil production is calculated (FIG. 1).
3. Based on performed lift simulation and mathematical modeling, family of the lift curves are established to allow lift of the oil to the surface for all values of parameters of an optimally producing well.
4. Stability of the system "well—reservoir" (points of IPR curve crossing the lift curve) is analyzed, as per the above methodology.
5. On the basis of the performed calculations, a corresponding characteristic of the bottomhole tool is determined (described as dPbottomhole tool=F (Qoil, GOR)) which is required for maintaining an optimal bottom hole pressure.
6. Based on the above, all critical bottomhole tool design parameters shall be determined and the actual bottomhole tool is manufactured.

7. The bottomhole tool along with all built-in sensors for measuring downhole parameters shall be then delivered downhole by means of a mandrel that is typically used for standard wireline and cable operations. Then the tool shall be placed at a fixed position in a lower part of the oil-well tubing.

A cable connected to bottomhole tool allows for measured values of bottom hole parameters to be transmitted to the surface, as well as for the control signals (generated by a PC-based control unit at the surface) to be sent downhole. The same cable provides required electrical power to the bottomhole tool.

Periodically, based on measured values of bottomhole parameters and results of formation testing as well as measured or calculated IPR, bottomhole pressure is adjusted and maintained at (or close to) an optimum level by means of a respective motion of the bottomhole tool needle.

Some course adjustment of the bottomhole pressure can alternatively be made by means of a surface choke, with the following fine-tuning by the bottomhole tool needle.

If maintaining the downhole pressure at an optimal level by using the bottomhole tool of the invention becomes difficult (e.g., due to a very significant variations of parameters of the system "well—reservoir" over time), the initial bottomhole tool shall be replaced with another bottomhole tool that is better suited to efficiently work in new conditions.

Even if replacement is needed, the most expensive "static" portion of bottomhole tool, which includes a downhole motor, remains in the tool, while just the telescopic needle (the least expensive part) needs to be replaced making the replacement operation cost-effective.

EXAMPLE OF USING THE BOTTOMHOLE TOOL OF THE INVENTION

Figure 5:
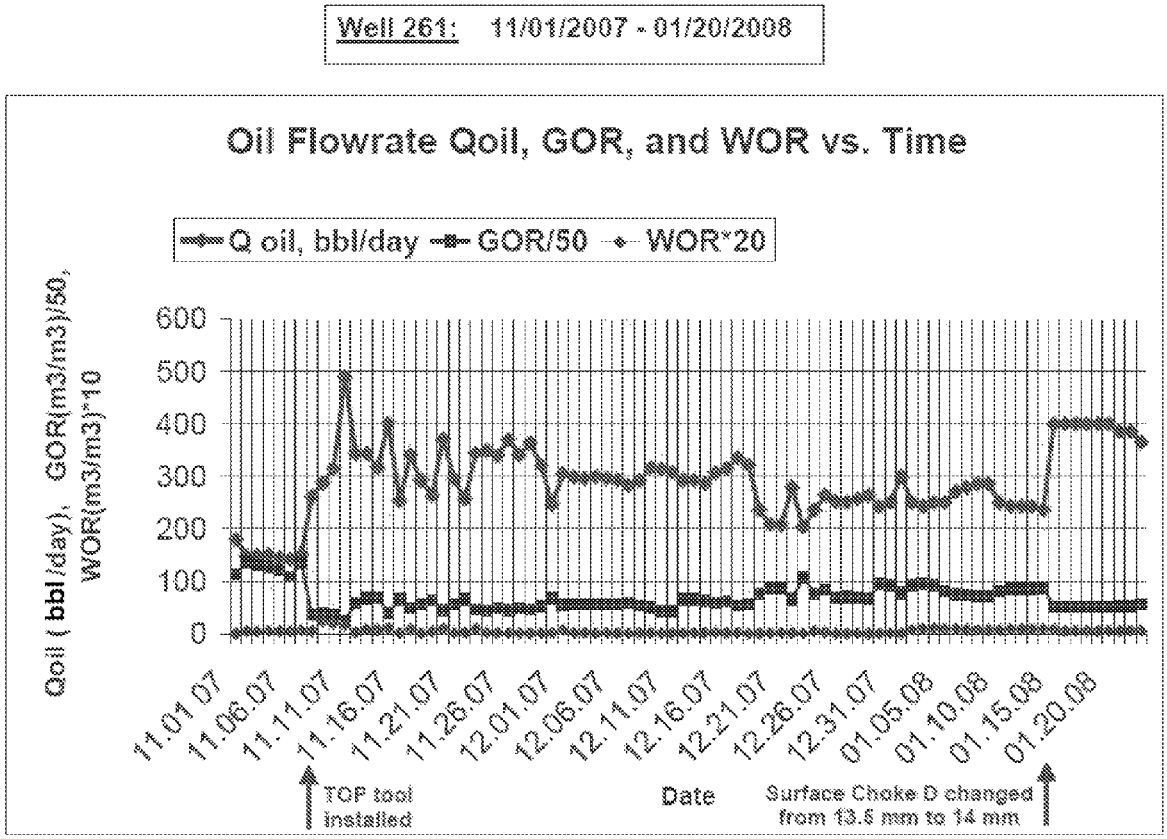
FIG. 5 is an example of increased oil production and recovery when using the tool of the invention in a sample well.

FIG. 5 contains oil recovery charts from a sample well. Initial installation of the bottomhole tool on Nov. 11, 2007 causes a marked increase in oil production and a drop in GOR. Subsequent adjustment made on Jan. 15, 2008 in the surface choke causes further increase in oil production. In summary, using the present invention resulted in the following achievements:

- Additional Oil received during two month period was 11,443 bbl (worth more than $1,000,000@$90/bbl)
- Bottomhole pressure was calculated at 1694 psi before the installation of the bottomhole tool of the invention (Nov. 02, 2007)
- After installation (Dec. 10, 2007), the bottomhole pressure increased to 1763 psi (+69 psi)
- Oil rate increased from 148 to 318 bbl/day
- GOR reduced from 38440 cft/bbl to 12440 cft/bbl
- WOR reduced from 0.27 to 0.05
- Ultimate Oil Recovery will increase significantly because the well was stabilized and GOR and WOR are reduced.

Optionally, as this technology develops, a downhole portion of the computer control unit can be used in conjunction with a surface-based portion of the control unit, two portions communicating to each other via an electrical cable. This may increase the system efficiency even more, as some calculations and corresponding adjustments could be performed automatically at the downhole location of the tool. Ultimately, the entire control unit can be mounted on the tool itself so that the entire system is located at the bottom of the well.

It is anticipated that adjustments to the needle position will be needed only on a periodic basis. In that case, another useful way to utilize the invention is to equip the bottomhole tool of the invention with a "wet-connect" electrical coupling means allowing the electrical connecting cable to connect and disconnect from the bottomhole tool from time to time. In that case, a single surface-based control unit (optionally mounted on a vehicle for greater mobility) can be used to operate and adjust many wells one-at-a-time. In this embodiment of the invention, the connecting cable is first lowered into an operating well and an electrical connection is established with a particular driving means. Next, the bottomhole parameters are communicated to the mobile control unit including sensor signal. The control unit then computed the necessary new position of the telescopic needle and downloads the driving signal to the driving unit. The driving unit then activates the motor such that the needle position is adjusted according to the calculations of the mobile control unit. The coupling means are then disconnected and the connecting cable is retrieved from the well. The mobile control unit is then moved to another well for a similar adjustment procedure.

In general, the bottomhole pressure can be controlled in one of three modes using the tool of the invention: fully automatic (the downhole-mounted control unit defines the location of the needle at all times based on predefined computer program, optionally with information from sensors), semi-automatic (surface-based control unit is used for operating the driving means leaving an option for human intervention), and manual (the tool is periodically retrieved and the needle position is manually adjusted). Each of the proposed control approaches has certain advantages and disadvantages.

The main design idea of the mechanical portion of bottomhole tool being moved by a driving means using an electrical motor can be potentially expanded and used for a surface choke application where this choke would have a very linear control characteristic.

Economic efficiency of the proposed technology for commercial applications is justified considering these advantageous factors:

- Increased current oil production rate
- Reduced current GOR
- Reduced current WOR
- Increased ultimate recovery index of the well and oil field
- Eliminated gas and water cones
- Improved stability of well performance
- Avoided premature loss of formation pressure and energy
- Increased life time of wells
- Prevented appearance of high viscosity areas in formation near bottomhole zone
- Increased formation's relative permeability coefficient by oil.
- Increased productivity index of the formation.
- Increased overall efficiency of gas-lift and pumps.
- Decreased electric energy consumed by pumps and gas-lift compressors.
- Improved fluid lift in tubing.
- Beneficial influence on other detrimental processes near bottomhole when pressure is low reduces formation sand washout, mechanical damages to the formation, and formation permeability loss occurring due to elastic stress and deformation.

Although the invention herein has been described with respect to particular embodiments, it is understood that these embodiments are merely illustrative of the principles and applications of the present invention. In particular, the driving means may be activated by compressed fluid or gas or the sensors may be adapted to transmit their signals wirelessly. It is therefore to be understood that numerous modifications may be made to the illustrative embodiments and that other arrangements may be devised without departing from the spirit and scope of the present invention as defined by the appended claims.

What is claimed is:

1. A method of optimizing of oil production from an oil well comprising steps as follows:

(a) determine a dependence of the oil flow rate on the bottomhole pressure in said well and create an inflow-pressure relationship curve;

(b) install a bottomhole tool at the bottom of said well, said tool incorporating a multi-stage_fluid resistor with a movable needle, said resistor and said needle having respective predefined geometries, whereby a position of said needle within said resistor in combination with said geometries defining a fluid resistance of oil flow through said fluid resistor and a bottomhole pressure in said well, said needle being driven to said position by a driving means controlled from a surface;

(c) defining a lift curve and intersection thereof with said Inflow-Pressure Relationship curve by adjusting the bottomhole pressure from the surface; and (d) creating a desired point of operation of said well by shifting the intersection between said lift curve and said Inflow-Pressure Relationship curve to a desired location via moving of said needle by said driving means.

2. The method as in claim 1, wherein said step (c) includes computing the desired position of said needle using a computer model including bottomhole parameters measured before installation of said bottomhole tool.

3. The method as in claim 1, wherein said bottomhole tool further includes at least one sensor for measuring at least one bottomhole parameter, said step (c) includes computing the desired location of said needle using a computer model including bottomhole parameters as measured before installation of said bottomhole tool as well as measured on-line by said sensor.

4. The method as in claim 3, wherein said at least one parameter measured on-line by said sensor is said bottomhole pressure.

* * * * *